US005168884A

United States Patent [19]

Baldwin et al.

[11] Patent Number: 5,168,884

[45] Date of Patent: Dec. 8, 1992

[54] SMOKING ARTICLES USING NOVEL PAPER WRAPPER

[75] Inventors: Sheryl D. Baldwin; Edward B. Sanders, both of Richmond; James L. Myracle, Midlothian; Barbro L. Goodman, Colonial Heights; Cynthia W. Arterbery, Chesterfield; Willard A. Geiszler, Richmond; Barton Floyd, Chester; Warren E. Claflin, Richmond, all of Va.

[73] Assignee: Philip Morris Incorporated, New York, N.Y.

[21] Appl. No.: 684,563

[22] Filed: Apr. 12, 1991

[51] Int. Cl.[5] ..... A24D 1/02

[52] U.S. Cl. ..... 131/365; 131/336

[58] Field of Search ..... 131/365, 296, 336

[56] References Cited

U.S. PATENT DOCUMENTS

| | | | |
|---|---|---|---|
| 2,733,720 | 2/1956 | Schur et al. . | |
| 2,738,791 | 3/1956 | Schur et al. . | |
| 2,754,207 | 7/1956 | Schur et al. . | |
| 4,407,308 | 10/1983 | Baker et al. . | |
| 4,420,002 | 12/1983 | Cline . | |
| 4,433,697 | 2/1984 | Cline et al. . | |
| 4,450,847 | 5/1984 | Owens . | |
| 4,461,311 | 7/1984 | Mathews et al. . | |
| 4,622,983 | 11/1986 | Mathews et al. . | |
| 4,805,644 | 2/1989 | Hampl, Jr. et al. . | |
| 4,881,557 | 11/1989 | Martin . | |
| 4,911,184 | 3/1990 | Case et al. . | |
| 4,915,118 | 4/1990 | Kaufman et al. . | |
| 4,962,773 | 10/1990 | White et al. | 131/296 |
| 4,964,427 | 10/1990 | Case et al. . | |
| 4,984,589 | 1/1991 | Riedesser . | |
| 4,998,543 | 5/1991 | Goodman et al. | 131/365 |

FOREIGN PATENT DOCUMENTS

| | | |
|---|---|---|
| 0407022A2 | 9/1990 | European Pat. Off. . |
| 0404580A1 | 12/1990 | European Pat. Off. . |
| 8504080 | 9/1985 | PCT Int'l Appl. . |

OTHER PUBLICATIONS

Resnik et al., "Factors Affecting Static Burning Rate," Tobacco Science XXXI, pp. 103-107, 1977.

Schur et al., "The Design of Low Yield Cigarettes," Tobacco Science, vol. 4, pp. 69-77, 1960.

Owens, Jr., "Effect of Cigarette Paper on Smoke Yield and Composition," *Recent Advances in Tobacco Science,* vol. 4, 32nd Tobacco Chemists' Research Conference, Oct. 30-Nov. 1, 1978, Montreal, Canada.

Wynder et al., *Tobacco and Tobacco Smoke,* p. 131, 1967.

Yamamoto et al., "Effect of Cigarette Circumference on Weight Loss during Puffs and Total Delivery of Tar and Nicotine," *Beitrage zur Tabakforschung International,* vol. 12, pp. 259-69, Nov. 1984.

Lago et al., "Cost Analysis of Options for Self-Extinguishing Cigarettes," Report No. RR-211, Jan. 14, 1987, prepared for Center for Fire Research and Applied Economics Group Mathematical Analysis Division National Bureau of Standards.

DeBardeleben et al., "Role of Cigarette Physical Characteristics on Smoke Compositions," *Recent Adv. Tob. Sci.,* vol. 4, pp. 85-111, 1978.

Jenkins et al., "Cigarette Smomke Formation Studies v. The Effects of the Cigarette Periphery on Mainstream Smoke Formation," Beitr. Tabakforsch., vol. 9, pp. 126-130, 1977.

Anonymous, "An Improved Sidestream Reducing Cigarette," Research Disclosure, No. 316, Abstract No. 31 673, p. 647, Aug. 1990.

*Primary Examiner*—Benjamin H. Layno

*Assistant Examiner*—Lynne A. Reichard

*Attorney, Agent, or Firm*—Donald L. Rhoads; Marta E. Gross

[57] ABSTRACT

The calcium carbonate filler level or the basis weight of a paper wrapper for a smoking article is varied to enable the designing of smoking articles with specific characteristics including a specific puff count, tar delivery and carbon monoxide delivery.

19 Claims, No Drawings

SMOKING ARTICLES USING NOVEL PAPER WRAPPER

BACKGROUND OF THE INVENTION

This invention relates to a smoking article, such as a cigarette, using a paper wrapper with a novel construction. Specifically, the smoking article of the invention uses wrappers which alter the characteristics of the smoking article including puff count, tar delivery and carbon monoxide delivery by adjustment of the paper wrapper's calcium carbonate filler level and of the paper wrapper's basis weight. These adjustments of the paper wrapper combined with changes in filter, paper porosity, burn control additive, or tobacco blend characteristics can be used to design specific smoking articles.

Cigarette paper has traditionally been used in the cigarette industry to control a number of properties of the completed cigarette including puff count, mainstream tar delivery and mainstream carbon monoxide delivery. In virtually all cases, however, changes to the cigarette paper have been restricted to two properties of the paper: paper porosity and level of burn control additive. The relationship of porosity to cigarette performance is well understood by the industry. For instance, as inherent paper porosity is increased, puff count and, therefore, total tar delivery, decrease. Tar per puff remains approximately constant. If, however, paper porosity is increased through perforation of the paper (increase in paper permeability), then puff count increases and tar per puff decreases due to air dilution during the puff.

Paper porosity also has an effect on mainstream carbon monoxide delivery. As porosity increases, mainstream carbon monoxide declines due to increased diffusion through the paper during smoking.

Level of burn control additive is also used to control tar and puff count. Increasing burn control additive over the range typically used (0.5% to 3.0%), increases burn rate, lowers puff count and decreases total tar delivery.

In all cases, these changes in the specifications of paper properties can be combined with changes in the specifications of filter properties to obtain a change in the final design of the cigarette. For instance, should one choose to increase the tar per puff, and therefore the subjective impact of a low delivery cigarette, without changing the total tar delivery, one can increase paper porosity (or level of burn control additive) to decrease puff count and then decrease filter efficiency or filter dilution in order to restore the total tar delivery to its former value. By the same token, if one desires to increase puff count and leave the total delivery constant, then one can decrease paper porosity (or level of burn control additive) to increase puff count, and then increase filter efficiency or dilution to lower the tar per puff. There are many examples known to the art where these types of paper porosity, burn control additive level and filter manipulations are carried out in order to achieve a desired cigarette design.

Despite the flexibility which can be achieved in cigarette design through the manipulation of paper porosity and level of burn control additive, there are instances when a desired cigarette design cannot be optimally achieved by controlling either of these two paper properties. Many examples are in the area of low delivery cigarettes; however, there are certain examples in the category of full flavor cigarettes as well. An example of a cigarette which cannot be achieved using normal practices would be an ultra low delivery cigarette (2 mg tar for a 100 mm cigarette) with reasonable taste characteristics. The puff count necessary to achieve this objective is about 7. Even with paper of essentially maximum porosity (46–50 Coresta units), and a high level of burn control additive, it is not possible to obtain less than 7.5 puffs.

Furthermore, controlling a cigarette's properties by the addition of burn control additives creates unwanted effects. High levels of burn control additive have been shown to increase the tendency of an ash to flake. High levels of burn control additive or changing paper porosity or filter ventilation may also produce an undesired decrease in the subjective impact of the smoking article including less taste. The subjective impact is also often sacrificed if a low tar delivery cigarette is designed with a tobacco blend to lower the tar delivery.

Thus, it would be desirable to provide a smoking article with a paper wrapper that can be used to achieve a smoking article with a desired puff count.

It would also be desirable to provide a smoking article with a paper wrapper that can be used to achieve a smoking article with a desired tar delivery.

It would further be desirable to provide a smoking article with a paper wrapper that can be used to achieve a smoking article with a desired carbon monoxide delivery.

It would further be desirable to provide a smoking article with a paper wrapper that can be used to achieve a smoking article with certain desired characteristics that does not require high levels of burn control additive, changes in tobacco blend, changes in paper porosity or changes in filtration ventilation or efficiency.

It would further be desirable to provide a smoking article with a paper wrapper that can be used to achieve a smoking article with certain desired characteristics without excessively decreasing the subjective impact, such as taste, of the smoking article.

SUMMARY OF THE INVENTION

It is therefore an object of this invention to provide a smoking article with a paper wrapper that can be used to achieve a smoking article with a desired puff count.

It is another object of this invention to provide a smoking article with a paper wrapper that can be used to achieve a smoking article with a desired tar delivery.

It is a further object of this invention to provide a smoking article with a paper wrapper that can be used to achieve a smoking article with a desired carbon monoxide delivery.

It is a further object of this invention to provide a smoking article with a paper wrapper that can be used to achieve a smoking article with desired characteristics without high levels of burn control additive or major changes in tobacco blend and without excessively decreasing the subjective impact of the smoking article.

In accordance with this invention there is provided a smoking article, such as a cigarette, that has a paper wrapper with a calcium carbonate level or basis weight that is varied to produce changes in puff count, tar delivery or carbon monoxide delivery of the cigarette. These characteristics of cigarettes can be changed by varying the calcium carbonate level or basis weight of the paper with or without making changes in paper porosity or burn control additive levels in the paper or by changing filter characteristics or the tobacco blend. Making these changes in a cigarette's characteristics allows the design of desired cigarettes without the use of excessively high levels of burn control additives. This invention also makes it possible to achieve designs of cigarettes which could not be done through variations of paper porosity, burn control additive and filter characteristics alone. Specific designs of smoking articles can be achieved with this invention while improving or not excessively decreasing the subjective impact of the smoking article.

The paper wrapper of this invention may be used for smoking articles of any length or circumference and having different fillers such as tobacco, expanded tobacco, a variety of blend types, reconstituted tobacco materials, stems, non-tobacco filler materials and combinations thereof. The paper wrapper of this invention is especially suited for use with expanded tobacco fillers because there is no need for excessively high levels of burn control additives.

DETAILED DESCRIPTION OF THE INVENTION

The paper wrapper of this smoking article invention may be made from flax or other cellulosic fibers. Between about 10% by weight and about 40% by weight of calcium carbonate is used as a filler. Preferably between about 30% by weight and about 36% by weight of calcium carbonate is used.

The paper wrapper should also have a basis weight of between about 15 g/m$^2$ and about 75 g/m$^2$, preferably between about 28 g/m$^2$ and about 35 g/m$^2$. In addition, the inherent porosity of the paper wrapper should be between about 15 Coresta units and about 55 Coresta units, preferably between about 20 Coresta units and about 35 Coresta units. A high porosity between about 40 Coresta units and about 55 Coresta units may be preferable for other applications, such as cigarettes designed for low tar delivery.

The paper may also be treated with low to moderate levels (between about 0.5% by weight and about 3.0% by weight) of a burn control additive. Such a burn control additive is an alkali metal salt, preferably a citrate such as potassium citrate. Sodium or potassium acetate, sodium or potassium fumarate, sodium or potassium succinate, sodium or potassium phosphate or other salts or mixtures thereof may be used. The purpose of the burn control additive includes improving ash characteristics and controlling puff count and the optimum level depends on the specific characteristics of the paper wrapper and the tobacco blend.

Finally, a filter can be added to the smoking article which can alter and dilute the mainstream delivery. The filtration efficiency or the filtration ventilation level can be altered to adjust the mainstream delivery of the smoking article. Other ventilation means may also be used besides ventilation provided by filters.

A particular example of such a smoking article has a paper wrapper with a calcium carbonate filler loading of 30% by weight to 36% by weight with a paper porosity of 47 Coresta units, a burn control additive level in the paper of I.7% by weight and a paper basis weight of 25 g/m$^2$. An alternative example of such paper wrapper has a basis weight of 28 g/m$^2$ to 35 g/m$^2$ with a calcium carbonate filler loading of 25% by weight, a paper porosity of 47 Coresta units and a burn control additive level of 1.7% by weight.

The invention will now be further explained, by way of example, with reference to data from individual cigarettes and data extrapolated from individual cigarettes.

EXAMPLE 1

A cigarette produced with a regular circumference of 24.8 mm, a 31.5 mm long filter and a 68 mm long tobacco rod yielded a puff count of 7.8 at 62% filter ventilation. Total tar delivery was 2.5 mg when smoked under standard machine smoking conditions. The wrapper used in this example consisted of a 25% by weight calcium carbonate loading with 2.5% by weight burn control additive. The wrapper had a 47 Coresta unit porosity and a basis weight of 25 g/m$^2$. This example shows that even with a paper of high porosity and a high level of burn control additive, it is not possible to obtain less than a 7.5 puff count.

EXAMPLE 2

As pointed out in Example 1 above, it is not possible to achieve a 100 mm cigarette with a seven puff count through adjustment of paper porosity and burn control additive level alone. However, if a porous paper (47 Coresta units) is used with a high level of burn control additive (2.5% by weight), then a cigarette with a further puff count reduction and a reduction in tar delivery can be designed by using a paper wrapper with a high level of calcium carbonate (36% by weight) and a 25 g/m$^2$ basis weight. This effect of using a higher level of calcium carbonate in a paper wrapper on cigarette puff count and tar delivery is presented below:

| | 25% $CaCO_3$ | 30% $CaCO_3$ | 36% $CaCO_3$ |
|---|---|---|---|
| Puff Count | 7.8 | 7.6 | 7.4 |
| Tar, mg | 2.5 | 2.4 | 2.3 |

EXAMPLE 3

The effect of paper wrapper calcium carbonate level on puff count as shown in Example 2 can also be demonstrated with a higher tar delivery cigarette that has other design differences. Data from cigarettes with 12% expanded tobacco, a filter ventilation of about 30% and a paper wrapper with a basis weight of 25 g/m$^2$, a burn control additive level of about 0.6% and a porosity of 32 Coresta units is presented below:

| | 24.0% $CaCO_3$ | 30.5% $CaCO_3$ | 39.0% $CaCO_3$ |
|---|---|---|---|
| Puff Count | 9.9 | 9.3 | 8.9 |
| Tar, mg | 8.3 | 8.0 | 8.2 |

The data shows a significant decrease in puff count over a paper wrapper calcium carbonate range from 24% to 39%. In contrast, data from a 16 mg tar delivery cigarette with the same design as above except with conventional tobacco and 11% filter ventilation, showed only a small puff count change over a similar range of paper wrapper calcium carbonate levels (see below). The 16 mg data, compared with Example 2 and the 8 mg cigarette above, indicates that changing the paper wrapper calcium carbonate level may have more of an effect on low tar cigarettes than high tar cigarettes.

| | 24.2% $CaCO_3$ | 30.5% $CaCO_3$ | 40.5 $CaCO_3$ |
|---|---|---|---|
| Puff Count | 9.1 | 8.8 | 8.7 |
| Tar, mg | 16.9 | 16.4 | 17.0 |

EXAMPLE 4

Alternatively, a constant level of calcium carbonate (25% by weight) in an increased basis weight paper (35 g/m$^2$), with the other variables the same as in Example 2, can also be used to design a cigarette with low puff count and tar delivery. Supporting data is presented below:

| | 25 g/m$^2$ | 30 g/m$^2$ | 35 g/m$^2$ |
|---|---|---|---|
| Puff Count | 7.8 | 7.4 | 7.0 |
| Tar, mg | 2.5 | 2.3 | 2.1 |

Of course, a combination of increased basis weight as shown in this example and an increased calcium carbonate as shown in Example 2 could be used for further puff count and tar delivery reduction.

EXAMPLE 5

The effect of basis weight on tar delivery and puff count as shown in Example 4 can also be demonstrated with a higher tar delivery cigarette that has other design differences. Data from cigarettes with about 20% expanded tobacco, a filter ventilation of 50% and with a paper wrapper with about 30% by weight calcium carbonate, 1.7% by weight burn control additive and a porosity of about 46 Coresta units is presented below:

| | 25 g/m$^2$ | 30 g/m$^2$ |
|---|---|---|
| Puff Count | 7.8 | 7.2 |
| Tar, mg | 6.7 | 6.5 |

EXAMPLE 6

Another type of cigarette which can provide a product advantage produced through manipulation of calcium carbonate level and basis weight of the paper wrapper is a cigarette with a reduced mainstream carbon monoxide level. This can be accomplished as follows. A cigarette with a given puff count and tar delivery can be changed to give a lower puff count and tar delivery by increasing the level of calcium carbonate in the paper. The original specifications for puff count and tar delivery can then be reestablished by increasing filter ventilation and decreasing filter efficiency. The increased filter ventilation will provide lower mainstream carbon monoxide. Data from cigarettes with a paper basis weight of 25 g/m$^2$, 2.5% by weight burn control additive and porosity of 47 Coresta units is presented below:

| | 25% $CaCO_3$ | 36% $CaCO_3$ | 36% $CaCO_3$ |
|---|---|---|---|
| Puff Count | 7.8 | 7.4 | 7.8 |
| Tar, mg | 2.5 | 2.3 | 2.5 |
| Ventilation, % | 62 | 62 | 72 |
| Filter Effic., % | 77 | 77 | 67 |
| CO, mg | 2.5 | 2.3 | 1.7 |

EXAMPLE 7

Filter ventilation can be decreased in order to provide improved subjective impact such as improved taste, without altering puff count or tar delivery. Decreasing filter ventilation will decrease puff count and increase tar delivery. Decreasing the level of calcium carbonate in the paper can be used to reestablish the original puff count. Any necessary adjustment to tar delivery can then be accomplished by changing filtration efficiency. The data below indicates that lowering the ventilation level for subjective impact purposes while maintaining tar and puff count can be accomplished by changing filter efficiency and reducing the level of calcium carbonate.

| | 36% $CaCO_3$ | 36% $CaCO_3$ | 30% $CaCO_3$ |
|---|---|---|---|
| Puff Count | 7.4 | 7.2 | 7.4 |
| Tar, mg | 2.3 | 2.2 | 2.3 |
| Ventilation, % | 62 | 56 | 56 |
| Filter Effic., % | 77 | 80 | 80 |

The teachings in the above examples are in no way restricted by the actual design of tar level, carbon monoxide or puff count of the illustrated cigarettes.

Thus it is seen that a paper wrapper for a smoking article, such as a cigarette, is provided that allows the design of smoking articles with specific characteristics such as a certain puff count, tar delivery or carbon monoxide delivery by changing the calcium carbonate level of the paper or the basis weight of the paper or both. Designing particular cigarettes, then, requires only small changes, if any, to burn control additive levels, tobacco blend, paper porosity, filter efficiency or filter ventilation level. This avoids the negative effects on the ash and on the cigarette's subjective impact, such as taste, that can be caused by large changes to burn control additive level, tobacco blend, paper porosity and filter adjustments.

One skilled in the art will appreciate that the present invention can be practiced by other than the described embodiments, which are presented for purposes of illustration and not of limitation, and the present invention is limited only by the claims that follow.

What is claimed is:

1. A smoking article comprising:

a tobacco filler surrounded by a paper wrapper, said paper wrapper having a calcium carbonate loading of between about 10% by weight and about 40% by weight;

a basis weight of between about 15 g/m$^2$ and 75 g/m$^2$;

an inherent porosity of between about 15 Coresta units and about 55 Coresta units; and between about 0.5% by weight and less than about 1.0% by weight of an alkali metal salt as a burn control additive.

2. A smoking article comprising:

a tobacco filler surrounded by a paper wrapper, said paper wrapper having a calcium carbonate loading of between about 10% by weight and about 40% by weight;

a basis weight of between about 15 g/m$^2$ and 75 g/m$^2$;

an inherent porosity of between about 15 Coresta units and about 55 Coresta units; and between more than about 1.0% by weight and about 3.0% by weight of an alkali metal salt as a burn control additive.

3. The smoking article of claim 1 or claim 2 wherein the paper wrapper inherent porosity is between about 20 Coresta units and about 35 Coresta units.

4. The smoking article of claim 1 or claim 2 wherein the paper wrapper inherent porosity is between about 40 Coresta units and about 55 Coresta units.

5. The smoking article of claim 1 or claim 2 wherein the paper wrapper calcium carbonate loading is between about 30% by weight and about 36% by weight.

6. The smoking article of claim 1 or claim 2 wherein the paper wrapper basis weight is between about 28 $g/m^2$ and about 35 $g/m^2$.

7. The smoking article of claim 2 wherein the paper wrapper calcium carbonate loading is between about 30% by weight and about 36% by weight, the paper wrapper basis weight is between about 28 $g/m^2$ and about 35 $g/m^2$; the paper wrapper inherent porosity is between about 40 Coresta units and about 55 Coresta units; and the paper wrapper has between about 1.5% by weight and about 2.0% by weight of the alkali metal salt as a burn control additive.

8. A method of altering the puff count of a smoking article comprising wrapping the contents of a smoking article in a paper wrapper, said paper wrapper having a calcium carbonate loading of between about 10% by weight and about 40% by weight; a basis weight of between about 15 $g/m^2$ and about 75 $g/m^2$; an inherent porosity of between about 15 Coresta units and about 55 Coresta units; and between about 0.5% by weight and less than about 1.0% by weight of an alkali metal salt as a burn control additive.

9. A method of altering the puff count of a smoking article comprising wrapping the contents of a smoking article in a paper wrapper, said paper wrapper having a calcium carbonate loading of between about 10% by weight and about 40% by weight; a basis weight of between about 15 $g/m^2$ and about 75 $g/m^2$; an inherent porosity of between about 15 Coresta units and about 55 Coresta units; and between more than about 1.0% by weight and about 3.0% by weight of an alkali metal salt as a burn control additive.

10. The method of claim 8 or claim 9 wherein the paper wrapper calcium carbonate loading is between about 30% by weight and about 36% by weight.

11. The method of claim 8 or claim 9 wherein the paper wrapper basis weight is between about 28 $g/m^2$ and about 35 $g/m^2$.

12. A method of altering the mainstream carbon monoxide delivery of a smoking article comprising wrapping the contents of a smoking article in a paper wrapper, said paper wrapper having a calcium carbonate loading of between about 10% by weight and about 40% by weight; a basis weight of between about 15 $g/m^2$ and about 75 $g/m^2$; an inherent porosity of between about 0.5% by weight and less than about 1.0% by weight of an alkali metal salt as a burn control additive.

13. A method of altering the mainstream carbon monoxide delivery of a smoking article comprising wrapping the contents of a smoking article in a paper wrapper, said paper wrapper having a calcium carbonate loading of between about 10% by weight and about 40% by weight; a basis weight of between about 15 $g/m^2$ and about 75 $g/m^2$; an inherent porosity of between about 15 Coresta units and about 55 Coresta units; and between more than about 1.0% by weight and about 3.0% by weight of an alkali metal salt as a burn control additive.

14. The method of claim 12 or claim 13 wherein the paper wrapper calcium carbonate loading is between about 30% by weight and about 36% by weight.

15. The method of claim 12 or claim 13 wherein the paper wrapper basis weight is between about 28 $g/m^2$ and about 35 $g/m^2$.

16. A method of altering the mainstream tar delivery in a smoking article comprising wrapping the contents of a smoking article in a paper wrapper, said paper wrapper having a calcium carbonate loading of between about 10% by weight and about 40% by weight; a basis weight of between about 15 $g/m^2$ and about 75 $g/m^2$; an inherent porosity of between about 15 Coresta units and about 55 Coresta units; and between about 0.5% by weight and less than about 1.0% by weight of an alkali metal salt as a burn control additive.

17. A method of altering the mainstream tar delivery in a smoking article comprising wrapping the contents of a smoking article in a paper wrapper, said paper wrapper having a calcium carbonate loading of between about 10% by weight and about 40% by weight; a basis weight of between about 15 $g/m^2$ and about 75% $g/m^2$; an inherent porosity of between about 15 Coresta units and about 55 Coresta units; and between more than about 1.0% by weight and about 3.0% by weight of an alkali metal salt as a burn control additive.

18. The method of claim 16 or claim 17 wherein the paper wrapper calcium carbonate loading is between about 30% by weight and about 36% by weight.

19. The method of claim 16 or claim 17 wherein the paper wrapper basis weight is between about 28 $g/m^2$ and about 35 $g/m^2$.

* * * * *